United States Patent [19]

Adams

[11] 4,028,842

[45] June 14, 1977

[54] POCKET WATCH DISPLAY KIT

[76] Inventor: John W. Adams, 4901 Riverton Lane, Bowie, Md. 20815

[22] Filed: May 4, 1976

[21] Appl. No.: 683,009

[52] U.S. Cl. ..... 46/1 R; 46/14; 46/232

[51] Int. Cl.[2] ..... A63H 33/00

[58] Field of Search ..... 46/1 R, 14, 15, 232

[56] References Cited

UNITED STATES PATENTS

| | | | |
|---|---|---|---|
| 2,974,265 | 3/1961 | Thoma | 46/232 X |
| 3,137,092 | 6/1964 | Salerno | 46/232 |

FOREIGN PATENTS OR APPLICATIONS

| | | | |
|---|---|---|---|
| 216,496 | 10/1924 | United Kingdom | 46/14 |

*Primary Examiner*—Hugh R. Chamberlee
*Assistant Examiner*—Robert F. Cutting
*Attorney, Agent, or Firm*—Robert D. Farkas

[57] ABSTRACT

A pocket watch display kit comprising a hollow box like housing forming an open ended chamber, a lateral support shelf affixed with the housing dividing the open ended chamber and forming an upper chamber and a lower chamber, the lateral support shelf adapted to support a pocket watch, a semi-oblongitudinal notch in the free edge of the upper lateral portion of the housing, the crown of the pocket accommodated between the internal edges of the notch, a pendulum pivotally disposed within the lower chamber, a first door element hingedly affixed over the upper chamber, the door element having a first transparent window therein permitting display of the face of the pocket watch, a lower panel element fixedly secured to the housing adjacent the lower lateral portion thereof, and a second door element hingedly affixed by second hinge means over the opening in the lower chamber above the lower panel, the second door element having a second transparent window therein permitting the viewing of the pendulum element and the lower chamber.

8 Claims, 2 Drawing Figures

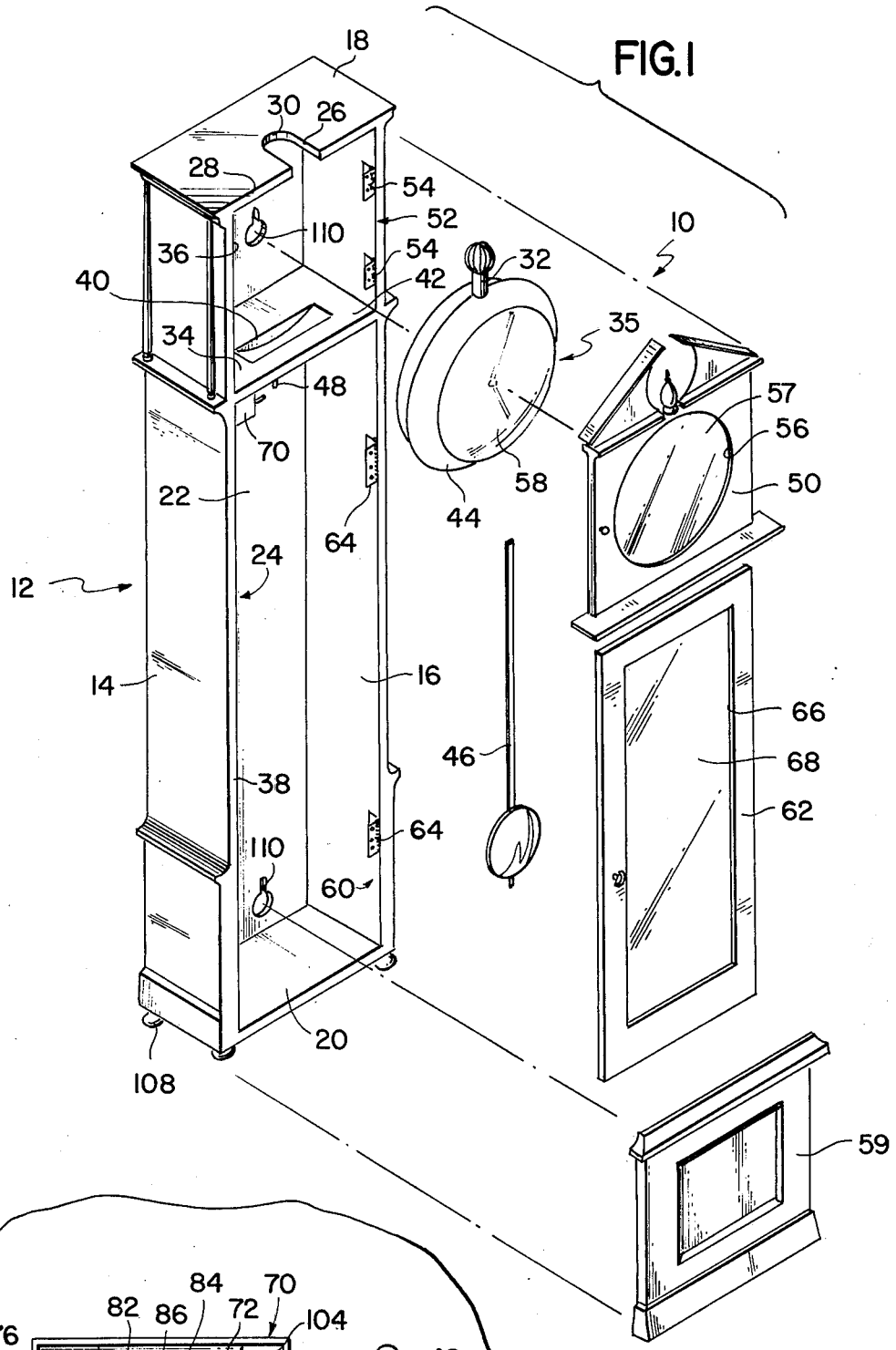
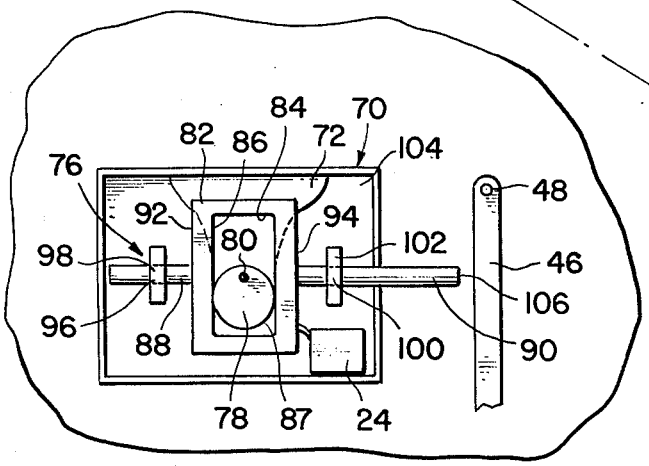
FIG.2

POCKET WATCH DISPLAY KIT

BACKGROUND OF THE INVENTION

1. Field of the Invention

The present invention realtes to displays for pocket watches, and more particularly, to a pocket watch display kit assembled by the user and adapted to accommodate various sized pocket watches.

2. Description of the Prior Art

The problem of having a safe place to store and display a pocket watch when not in use has been apparent since pocket watches were first used. Also, pocket watches are frequently passed along from one generation to the next as family heirlooms. Although the pocket watches may not be used and carried by the owner, on his person, he is often desirous to display and protect the pocket watch because of sentimental value and for time keeping functions.

A combination pocket watch and display form is disclosed in U.S. Pat. No. Des. 129,896 issued to W. B. Cohen on Oct. 7, 1941. This invention teaches a housing having a pair of pivotally affixed arcuate elements adapted to circumscribe the circumference of and secure a pocket watch within an open upper portion of a housing. While this device does support a pocket watch the pocket watch is exposed to dust and the like in the atmosphere and only a limited range of different sized pocket watches may be accommodated.

The present invention overcomes the shortcomings in the prior art by providing a pocket watch display kit which completely encloses therein a pocket watch except for the crown thereof, displays the face of the pocket watch, and may be altered to accommodate different sized pocket watches during construction by the user.

SUMMARY OF THE INVENTION

Therefore, it is a primary object of the present invention to provide a pocket watch display kit which completely encloses therein a pocket watch except for the crown thereof.

A further object is to provide a pocket watch display kit which may be altered during construction to accommodate different sized watches.

A still further object is to provide a pocket watch display kit which includes a pendulum element adapted to swing simulating an actual grandfather clock movement.

Another object is to provide a pocket watch kit having means for producing a click like sound similar to the sound produced by a grandfather clock.

These objects, as well as further objects and advantages, of the present invention will become readily apparent after reading the description of a non-limiting illustrative embodiment and the accompanying drawing.

The present invention provides a pocket watch display kit which may be altered during construction to accommodate several different sized pocket watches. The user may finish the kit in various manners to enhance the intended surrounding decor. The kit includes a hollow box like housing having lateral side portions, an upper lateral portion and a lower lateral portion each fixedly secured to a back portion and to adjacent portions forming an open ended chamber therein, the upper lateral portion has a semi-oblongitudinal notch in the free end thereof extending toward the back portion. The interior edges of the notch are adapted to accommodate a pocket watch crown therebetween. A lateral support shelf is affixed within the chamber substantially parallel to the upper lateral portion and adjacent thereto thereby defining an upper and a lower chamber. An arcuate groove is disposed in the surface of the lateral support shelf opposite the upper lateral portion and is adapted to accommodate the circular edge of a pocket water. The lateral support element is adapted to support the pocket watch within the upper chamber when the circular edge of the pocket watch is placed in the arcuate groove and the crown of the watch is placed within the notch. A pendulum element is disposed within the lower chamber and is pivotally affixed by a pivot to the lateral support shelf. A first door element is hingedly affixed over the opening in the upper chamber by first hinge means. A tranparent window element affixed within an opening disposed in the first door element permits the viewing of the face of the pocket watch placed in the first chamber. A lower panel element is fixedly secured to the housing partially covering the opening in the lowermost portion of the lower chamber. A second door element is hingedly affixed by second hinge means to the housing over the openings in the lower chamber which is above the lower front panel. The second door element has an opening and a second transparent window disposed therein. The second transparent window permitting the viewing of the pendulum element.

BRIEF DESCRIPTION OF THE DRAWINGS

In order that the present invention may be more fully understood it will now be described by way of example, with reference to the accompanying drawings in which:

FIG. 1 illustrates an exploded view in perspective of the preferred embodiment of the present invention; and FIG. 2 illustrates a front plan view of the propelling means.

DESCRIPTION OF THE PREFERRED EMBODIMENT

Referring now to the figures, and more particularly to FIG. 1, there is illustrated therein a pocket watch display kit 10. The kit 10 has several parts for construction including a hollow box like housing 12 having lateral side portions 14 and 16, an upper lateral portion 18 and a lower lateral portion 20 each adapted to be fixedly secured to a back portion 22 and to adjacent portions forming an open ended chamber 24 therein. The upper lateral portion 18 has a semi-oblongitudinal notch 26 therein. The notch 26 extends inwardly from the free edge 28 of the upper lateral portion 18 toward the back portion 22. The internal edges 30 of the notch 26 are adapted to accommodate a pocket watch crown 32 therebetween and to permit free rotation of the crown 32 for winding.

A lateral support shelf 34 is affixed within the chamber 24 substantially parallel to the upper lateral portion 20 and adjacent thereto thusly dividing the chamber 24 into an upper chamber 36 and a lower chamber 38. The exact positioning of the lateral support shelf 34 is determined by the user during assembly and depends on the dimensions of the pocket watch 35 to be housed. An arcuate groove 40 is disposed in the upper surface 42 of the lateral support shelf 34 and is adapted to accommodate the circular edge 44 of the pocket watch 35. When the circular edge 44 of the watch 35 is placed in the arcuate groove 40 and the crown 32 is placed in the notch 26, the pocket watch 35 is supported within the upper chamber 36.

A pendulum element 46 is adapted to be disposed within the lower chamber 38 and is pivotally affixed by a pivot 48 to the lateral support shelf 34. The longitudinal axis of the pivot 48 is substantially normal to the back portion 22.

A first door element 50 is adapted to be hingedly affixed to the housing 12 over the opening 52 in the upper chamber 36 by first hinge means in the form of a pair of butterfly type coil spring urged hinges 54. The first door element 50 has an opening 56 therein and a first transparent window element 57 fixedly secured in the opening 56. The first transparent window element 57 and the opening 56 are generally circular in shape and conform to the face 58 of the pocket watch 35 permitting the viewing thereof.

A lower panel element 59 is adapted to be fixedly secured to the housing 12 parially covering the opening 60 in the lower chamber 38.

A second door element 62 is adapted to be hingedly affixed by second hinge means in the form of a pair of butterfly type coil spring urged hinges 64 to the housing 12 over the remaining portion of the opening 60 not covered by the lower panel element 59. The second door element 62 is provided with an opening 66 therein and a second transparent window element 68 disposed therein which permits the viewing of the pendulum element 46.

The lateral side portions 14 and 16, the upper lateral portion 18, the lower lateral portion 20, the back portion 22, the lateral support shelf 34, the first door element 50, the lower panel element 59 and the second door element 62 may be constructed of wood, plastic, ceramic, or the like, may be supplied as separate parts or in various stages of assembly, the final construction and decoration to be executed by the purchaser.

The kit 10 may also be supplied with propelling means 70 adapted to impart a swinging motion to the pendulum element 46 about the pivot 48 thereof.

FIG. 2 illustrates the propelling means 70 which preferably include a battery powered motor 72, a battery means 74, and an eccentric drive means 76 affixed to the motor 72. The eccentric drive means 76 preferably includes a circular disk like element 78 affixed to the rotating shaft 80 of the motor 72. The central axis of the disc like element 78 is parallel but not coaxial to the longitudinal axis of the shaft 80. A generally rectangular shaped element 82 has an oblongitudianl opening 84 therein the inner edges 86 thereof adapted to slideably cooperate with the outer arcuate edges 87 of the disk like element 78 thereby causing the generally rectangular shaped element 82 to reciprocate when the shaft 80 rotates. A first rod element 88 and a second rod element 90 are fixedly secured to the opposite reciprocating outer edges 92 and 94 of the rectangular shaped element 82. The first rod element 80 journals with an aperture 96 disposed in a support element 98 and the second rod element 90 journals with an aperture 100 disposed in a support element 102. The support element 98 and the support element 102 are fixedly secured to a supporting 104 thereof supporting the rectangular shaped element 82. The free end 106 of the second rod element 90 during reciprocation is adapted to contact the pendulum element 46 producing a clicking sound and imparting a swinging motion to the pendulum element 46. The clicking sound simulates the actual sound produced by a grandfather clock.

A plurality of padded feet elements 108 may be affixed to the lower lateral portion 20 and a plurality of mounting holes 110 may be disposed in the back portion 22 as shown in FIG. 1.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. Pocket watch display kit comprising:

a hollow box like housing including lateral side portions, an upper lateral portion and a lower lateral portion each fixedly secured to a back portion and to adjacent portions forming an open ended chamber therein, said upper lateral portion having a semioblongitudinal notch in the free edge thereof extending toward said back portion, the internal edges of said notch adapted to accommodate a pocket watch crown therebetween, said internal edges permitting the free rotation of said crown;

a lateral support shelf affixed within said chamber substantially parallel to said upper lateral portion and adjacent thereto, said lateral support shelf dividing said chamber into an upper chamber and a lower chamber, said lateral support shelf having an arcuate groove disposed in the surface thereof opposite said upper lateral portion, said arcuate groove adapted to accommodate the circular edge of a pocket watch, said lateral support shelf thereby supporting said pocket watch within said first chamber when said circular edge thereof is placed in said arcuate groove and said crown is placed within said notch;

a pendulum element disposed within said lower chamber and pivotally affixed by a pivot to said lateral support shelf, the longitudinal axis of said pivot substantially normal to said back portion;

a first door element hingedly affixed over the opening in said upper chamber by first hinge means, said first door element having an opening and a first transparent window element disposed therein, said first window element permitting visual access to the face of said pocket watch;

a lower panel element fixedly secured to said housing partially covering the opening in the lowermost portion of said lower chamber; and a second door element hingedly affixed by second hinge means to said housing over the opening in said lower chamber above said front panel, said second door element having an opening and a second transparent window element therein, said second transparent window permitting viewing of said pendulum element.

2. A pocket watch display kit as claimed in claim 1 further comprising propelling means adapted to impart a swinging motion to said pendulum element about said pivot thereof.

3. A pocket watch display kit as claimed in claim 2, wherein said propelling means comprises a battery powered motor, battery means adapted to power said motor and eccentric drive means affixed to said motor.

4. A pocket watch display kit as claimed in claim 3, wherein said eccentric drive means comprises a circular disc like element affixed to the rotating shaft of said motor, the central axis of said disc like element parallel to but not coaxial to the longitudinal axis of said shaft, a generally rectangular shaped element having an oblongitudinal opening therein the inner edges of said oblongitudinal opening adapted to slideably cooperate with the outer arcuate edges of said disc like element thereby causing said generally rectangular shaped element to reciprocate when said shaft rotates, a first rod element and a second rod element fixedly secured to opposite reciprocating outer edges of said rectangular shaped element, a pair of support elements having apertures therethrough, said apertures adpated to slideably cooperate with a portion of said rods positioned therein, said support elements affixed to a supporting surface and supporting said rectangular shaped element, the free end of said second rod adapted to contact said pendulum element thereby producing a click like sound and to impart a swinging motion to said pendulum.

5. A pocket watch display kit as claimed in claim 1, wherein said first hinge means comprises a pair of butterfly type coil spring urged hinges.

6. A pocket watch display kit as claimed in claim 1, wherein said second hinge means comprises a pair of butterfly type coil spring urged hinges.

7. A pocket watch display kit as claimed in claim 1, wherein a plurality of padded feet are fixedly secured to the outer surface of said lower lateral portion.

8. A pocket watch display kit as claimed in claim 1, wherein a plurality of mounting holes are disposed through said back portion.

* * * * *